US011293247B2

(12) United States Patent
Dolog et al.

(10) Patent No.: US 11,293,247 B2
(45) Date of Patent: Apr. 5, 2022

(54) FRAC PLUG AND METHOD FOR FRACTURING A FORMATION

(71) Applicants: Rostyslav Dolog, Houston, TX (US); Yash Parekh, Calgary (CA)

(72) Inventors: Rostyslav Dolog, Houston, TX (US); Yash Parekh, Calgary (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/776,161

(22) Filed: Jan. 29, 2020

(65) Prior Publication Data

US 2020/0165889 A1 May 28, 2020

Related U.S. Application Data

(63) Continuation-in-part of application No. 15/262,643, filed on Sep. 12, 2016, and a continuation-in-part of application No. 15/262,443, filed on Sep. 12, 2016, now abandoned.

(51) Int. Cl.

| | |
|---|---|
| ***E21B 36/04*** | (2006.01) |
| ***E21B 33/128*** | (2006.01) |
| ***E21B 29/02*** | (2006.01) |
| ***E21B 33/129*** | (2006.01) |

(52) U.S. Cl.

CPC ..... *E21B 29/02* (2013.01); *E21B 33/128* (2013.01); *E21B 33/1293* (2013.01); *E21B 36/04* (2013.01)

(58) Field of Classification Search

None

See application file for complete search history.

(56) References Cited

U.S. PATENT DOCUMENTS

| | | | | |
|---|---|---|---|---|
| 2,555,627 | A | 6/1951 | Baker | |
| 5,094,769 | A | 3/1992 | Anderson, Jr. et al. | |
| 5,301,754 | A | 4/1994 | Cowam et al. | |
| 5,307,876 | A | 5/1994 | Cowan et al. | |
| 6,230,804 | B1 | 5/2001 | Mueller et al. | |
| 6,394,180 | B1 | 5/2002 | Berscheidt et al. | |
| 6,491,116 | B2 | 12/2002 | Berscheidt et al. | |
| 6,739,398 | B1 * | 5/2004 | Yokley | E21B 23/01 166/123 |
| 7,036,586 | B2 | 5/2006 | Roddy et al. | |
| 7,740,079 | B2 | 6/2010 | Clayton et al. | |
| 8,496,052 | B2 | 7/2013 | Frazier | |
| 8,592,353 | B2 | 11/2013 | Dalrymple et al. | |
| 2005/0124501 | A1 | 6/2005 | Reddy et al. | |
| 2005/0161212 | A1 | 7/2005 | Leismer et al. | |
| 2006/0086503 | A1 | 4/2006 | Reddy et al. | |

(Continued)

FOREIGN PATENT DOCUMENTS

| | | | |
|---|---|---|---|
| WO | 2018048568 | A1 | 3/2018 |

OTHER PUBLICATIONS

"Material Property Characterization of Ultra-High Performance Concrete", U.S. Department of Transportation Federal Highway Administration, Research, Development, and Technology, Turner-Fairbank Highway Research Center, McLean, VA, Aug. 2006; 188 pages.

(Continued)

*Primary Examiner* — Charles R Nold

(74) *Attorney, Agent, or Firm* — Cantor Colburn LLP

(57) ABSTRACT

A downhole barrier having a component thereof comprising a spalling material.

19 Claims, 6 Drawing Sheets

(56) References Cited

U.S. PATENT DOCUMENTS

| | | | |
|---|---|---|---|
| 2007/0207335 | A1 | 9/2007 | Karandikar et al. |
| 2008/0070810 | A1 | 3/2008 | Mang |
| 2008/0103065 | A1 | 5/2008 | Reddy et al. |
| 2008/0251006 | A1 | 10/2008 | Didenko et al. |
| 2008/0271898 | A1 | 11/2008 | Turley et al. |
| 2009/0018240 | A1 | 1/2009 | Becker et al. |
| 2009/0133606 | A1 | 5/2009 | Reddy et al. |
| 2010/0163237 | A1 | 7/2010 | Boney et al. |
| 2010/0290999 | A1 | 11/2010 | Kim et al. |
| 2011/0048740 | A1 | 3/2011 | Ward et al. |
| 2011/0086942 | A1 | 4/2011 | Robisson et al. |
| 2011/0127464 | A1 | 6/2011 | Zinn et al. |
| 2011/0240295 | A1 | 10/2011 | Porter et al. |
| 2011/0315403 | A1 | 12/2011 | Nard et al. |
| 2012/0231979 | A1 | 9/2012 | Peiffer et al. |
| 2013/0096038 | A1 | 4/2013 | Kim et al. |
| 2013/0139727 | A1 | 6/2013 | Constantz et al. |
| 2013/0277044 | A1 | 10/2013 | King et al. |
| 2014/0011903 | A1 | 1/2014 | Bosynak et al. |
| 2015/0102265 | A1 | 4/2015 | Russell et al. |
| 2016/0097255 | A1* | 4/2016 | Doane ..... E21B 33/128 166/308.1 |
| 2016/0160611 | A1 | 6/2016 | Zhang et al. |
| 2016/0258269 | A1 | 9/2016 | Musso et al. |
| 2016/0298407 | A1 | 10/2016 | Takahashi et al. |
| 2017/0015896 | A1 | 1/2017 | Cox et al. |
| 2018/0044570 | A1 | 2/2018 | Fernandez et al. |
| 2018/0072938 | A1 | 3/2018 | Mazyar et al. |
| 2018/0073325 | A1 | 3/2018 | Dolog et al. |

OTHER PUBLICATIONS

"Material Safety Data Sheet", Ductal Premix, Lafarge North America Inc., Mar. 1, 2011; 6 pages.

"Ultra High Performance Concrete," NPCA White Paper, Guide To Manufacturing Architectural Precast UHPC Elements, National Precast Concrete Association; 19 pages.

"Ultra-High Performance Concrete: A State-of-the-Art Report for the Bridge Community", Publication No. FHWA-HRT-13-060, U.S. Department of Transportation, Federal Highway Administration, Research, Development, and Technology, Jun. 2013; 176 pages.

Abbas, et al. "Ultra-High Performance Concrete: Mechanical Performance, Durability, Sustainability and Implementation Challenges", International Journal of Concrete Structures and Materials, vol. 10, No. 3, Sep. 2016; pp. 271-295.

Adams, et al. "Preparation and characterization of sulfonic acid-functionalized single-walled carbon nanotubes", Physica E41 (2009) 723-728.

Bei et al., "Investigation on spalling resistance of ultra-high-strength concrete under rapid heating and rapid cooling", Case Studies in Construction Materials 4 (2016) 146-153.

Choe et al., "Evaluation of the mechanical properties of 200 MPa ultra-high-strength concrete at elevated temperatures and residual strength of column", Construction and Building Materials 86 (2015) 159-168.

Cwirzen, et al. "Surface decoration of carbon nanotubes and mechanical properties of cement/carbon nanotube composites", Advances in Cement Research, 2008, 20, No. 2, April; pp. 65-73.

Dugat, et al. "Mechanical properties of reactive powder concretes", Materials and Structures/MaMriaux et Constructions, vol. 29, May 1996; pp. 233-240.

Eike W. Klingsch, "Explosive spalling of concrete in fire", ETH Zurich Research Collection, Publication Jun. 2014.

Eisenbeisz, Hadley G. "South Dakota's First HPC Bridge", South Dakota Department of Transportation, Birdge Views Issue No. 16, Jul./Aug. 2001; 6 pages.

Heinz et al. "Effect of Heat Treatment Method on the Properties of UHPC", Ultra-High Performance Concrete and Nanotechnology in Construction, Proceedings of Hipermat, 3rd International Symposium on UHPC and Nanotechnology for High Performance Construction Materials, Kassel, Mar. 7-9, 2012 11 pages.

International Search Report, International Application No. PCT/US2017/046279, dated Nov. 22, 2017, Korean Intellectual Property Office; International Search Report 4 pages.

International Search Report, International Application No. PCT/US2017/046278, Korean Intellectual Property Office; International Search Report 3 pages.

International Written Opinion, International Application No. PCT/US2017/046279, dated Nov. 22, 2017, Korean Intellectual Property Office; International Witten Opinion 10 pages.

International Written Opinion, International Application No. PCT/US2017/046278, Korean Intellectual Property Office; International Written Opinion 12 pages.

Kang, et al. "Mechanical Properties of Various Concrete After High Temperature Exposure", International Journal of Latest Trends in Engineering and Technology, vol. 9 Issue 1, pp. 92-96.

Kim, Yail J. "Recent Advances in Ultra-high Performance Concrete", Department of Civil Engineering, University of Colorado Denver, Dec. 8, 2013; 10 pages.

Klingsch et al., "High- and Ultrahigh-Performance Concrete: A Systematic Experimental Analysis on Spalling", ETH Zurich, Institute of Structural Engineering, Switzerland.

Kushartomo, et al. "Mechanical behavior of reactive powder concrete with glass powder substitute", The 5th International Conference of Euro Asia Civil Engineering Forum, Procedia Engineering 125 ( 2015 ) 617-622.

Kusumawardaningsih, et al. "UHPC compressive strength test specimens: Cylinder or cube?", The 5th International Conference of Euro Asia Civil Engineering Forum, Procedia Engineering 125 ( 2015 ) 1076-1080.

Li et al., "Tensile Properties of Hybrid Fiber-Reinforced Reactive Powder Concrete After Exposure to Elevated Temperatures", International Journal of Concrete Structures and Materials, vol. 10, No. 1, pp. 29-37, Mar. 2016.

Li, Victor C. "Engineered Cementitious Composites (ECC)—Material, Structural and Durability Performance", University of Michigan, Aug. 30, 2007, Chapter 24, pp. 1-78.

Lubbers, Anna R. "Bond Performance Between Ultra-High Performance Concrete and Prestressing Strands", A Thesis Presented to the Faculty of the College of Engineering and Technology of Ohio University, Aug. 2003; 155 pages.

Lucero, Catherine "Ultra-High Performance Concrete Used as a Coating" Research and Development Office Science and Technology Program (Interim Report), Sep. 2015; 11 pages.

Luo, et al. "Nanofluid of graphene-based amphiphilic Janus nanosheets for tertiary or enhanced oil recovery: High performance at low concentration", PNAS Early Edition, May 25, 2016; 6 pages.

Munoz, Miguel Angel Carbonell "Compatibility of ultra high performance concrete as repair material : bond characterization with concrete under different loading scenarios", Thesis Paper, Michigan Technological University, 2012; 168 pages.

Musso, et al., "Stimuli-Responsive Cement-Reinforced Rubber", Department of Civil and Enviommental Engineering, Massachussetts Institute of Technology, Apr. 15, 2014; 7 pages.

Nematollahi, et al. "A review on ultra high performance 'ductile' concrete (UHPdC) technology", International Journal of Civil and Structural Engineering, vol. 2, No. 3, 2012; 16 pages.

Peng et al. "Combined curing as a novel approach to improve resistance of ultra-high performance concrete to explosive spalling under high temperature and its mechanical properties", Cement and Concrete Research, 109 (2018) 147-158.

Phan, Long T.; "High-Strength Concrete at High Temperature—An Overview"; Published: Jun. 1, 2002; International Symposium on Utilization of High Strength High Performance Concrete; Leipzig, GE; 15 pages.

Pyo, Sukhoon "Characteristics of Ultra High Performance Concrete Subjected To Dynamic Loading", A dissertation submitted in partial fulfillment of the requirements for the degree of Doctor of Philosophy (Civil Engineering) in the University of Michigan, 2014; 208 pages.

Raki, Laila, et al. "Cement and Concrete Nanoscience and Nanotechnology", Materials 2010, 3, 918-942 (25 pp.).

(56) References Cited

OTHER PUBLICATIONS

Richard, et al. "Reactive Powder Concretes with High Ductility and 200-800 MPa Compressive Strength", Concrete Technology, vol. 14, Mar. 1, 1994; 12 pages.
Sherman, Nicole "Ductal ®, a new Ultra High Performance Concrete", FINECONCRETE , Oct. 21, 2015; 3 pages.
Shi, et al. "A review on ultra high performance concrete: Part I. Raw materials and mixture design", Construction and Building Materials, College of Civil Engineering, Hunan University, Changsha 410082, PR China, Dec. 2015; 12 pages.
Shi, et al. "High Temperature Shape Memory Polymers", Macromolecules, American Chemical Society, 2013; 8 pages.
Sobolev, Konstantin, et al. "Nanomaterials and Nanotechnology for High-Performance Cement Composites", Proceedings of ACI Session on "Nanotechnology of Concrete: Recent Developments and Future Perspectives" Nov. 7, 2006, Denver, USA.
Tai et al., "Mechanical properties of steel fiber reinforced reactive powder concrete following exposure to high temperature reaching 800° C.", Nuclear Engineering and Design 241 (2011) 2416-2424.
Tohver, et al. "Nanoparticle halos: A new colloid stabilization mechanism", University of California, vol. 98, No. 16, Jul. 31, 2001; 5 pages.
Vaitkevičius, et al. "Influence of Silica Fume on Ultrahigh Performance", World Academy of Science, Engineering and Technology, International Journal of Civil, Environmental, Structural, Construction and Architectural Engineering vol. 8, No. 1, 2014; 6 pages.
Van Thu Le, et al. "Surface modification and functionalization of carbon nanotube with some organic compounds", Advances in Natural Sciences: Nanoscience and Nanotechnology, 4 (2013) 035017 (5pp).
Wang, et al. "A review on ultra high performance concrete: Part II. Hydration, microstructure and properties", Construction and Building Materials 96 (2015) 368-377.
Wu, et al. "Janus graphene oxide nanosheets prepared via Pickering emulsion template", CARBON 93 (2015) 473-483.
Zheng et al., "Compressive behaviour of hybrid fiber-reinforced reactive powder concrete after high temperature", Materials and Design 41 (2012) 403-409.
International Search Report for International Application No. PCT/US2021/015002, International Filing Date Jan. 26, 2021, dated, May 6, 2021, 4 pages.
Written Opinion for International Application No. PCT/US2021/015002, International Filing Date Jan. 26, 2021, dated, May 6, 2021, 4 pages.

* cited by examiner

FRAC PLUG AND METHOD FOR FRACTURING A FORMATION

CROSS REFERENCE TO RELATED APPLICATIONS

This application is a continuation-in-part and claims the benefit of an earlier filing date from U.S. Non-provisional application Ser. No. 15/262,643, filed on Sep. 12, 2016; and U.S. Non-provisional application Ser. No. 15/262,443, filed on Sep. 12, 2016, the entire disclosure of which is incorporated herein by reference.

BACKGROUND

Barriers such as frac plugs, bridge plugs, liner wiper plugs, pump down plugs, frac sleeves, whip-stocks, etc. are commonly used downhole tools. Barriers in the downhole industry temporarily result in isolation of zones in a well whether that is the actual purpose (plugs, etc.) or a result (whipstocks, etc.). For plugs, their use allows pressurized fluids to treat the target zone or isolated portion of a formation. Regardless of whether the barrier creates a zone by design or by effect, the barrier itself generally will experience significant loads not the least of which will be setting loads. In operation, forces are applied to components of a barrier generally causing a seal member and/or slips to deform and fill a space between the plug and a casing. The setting load can be as high as 100,000 lbf. Upon setting, the barrier can be subjected to high or extreme pressure conditions. Accordingly, barriers include various components thereof that must be capable of withstanding high pressures or forces during the setting and subsequent operations. This leads to difficulty in removal of the barriers after an operation that relies upon them or their useful lives have terminated. There is a continuing need in the art for tools or components of tools that have high compressive strength, are cost effective are relatively easily removable and can be readily made.

BRIEF DESCRIPTION

Disclosed is a downhole barrier having a component thereof comprising a spalling material.

BRIEF DESCRIPTION OF THE DRAWINGS

The following description should not be considered limiting in any way. With reference to the accompanying drawings, like elements are numbered alike:

FIG. 1 illustrates a barrier during run in;

DETAILED DESCRIPTION

Figure 1:
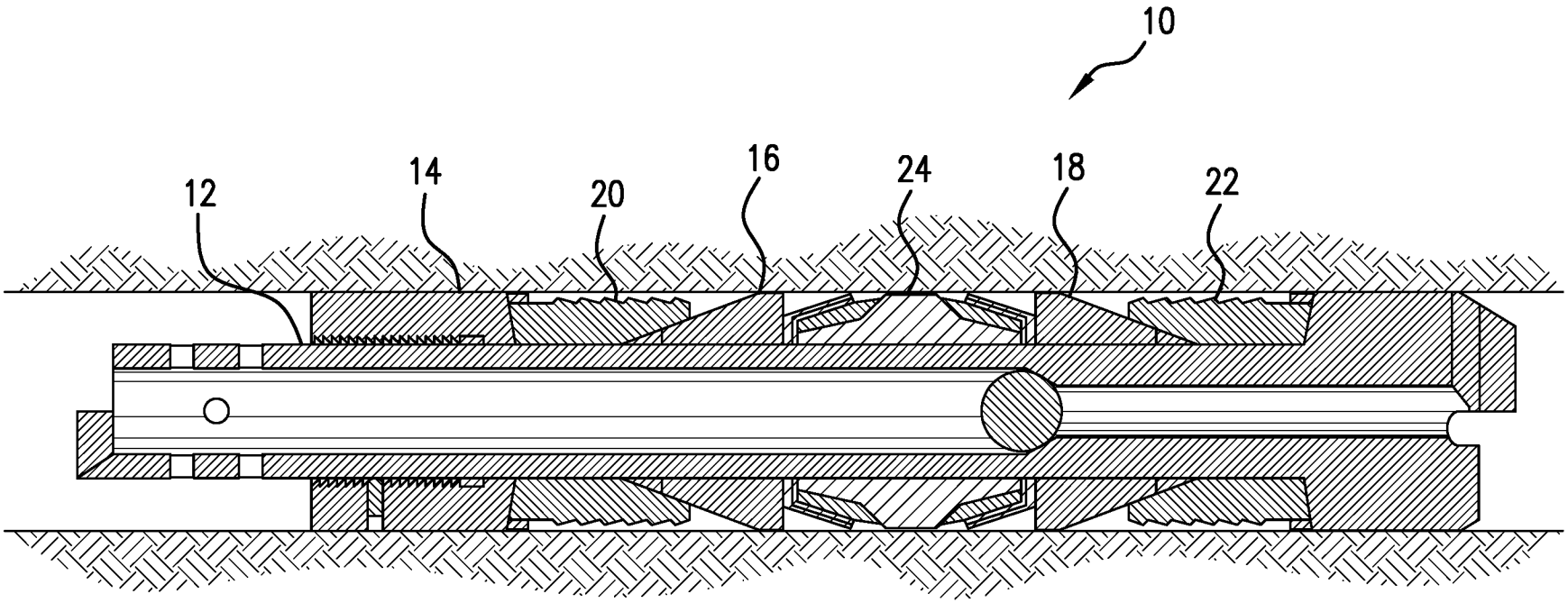

Referring to FIG. 1, a barrier 10, which may be of any of the types noted in the background hereof or other similar structures, is here illustrated in the form of a frac plug. Barrier 10 includes a number of components, namely a mandrel 12, a pusher 14, cones 16 and 18, sets of slips 20 and 22 and an element 24. It will be immediately appreciated by one of ordinary skill in the art that the components illustrated and identified are not in themselves new. These are components that have been used in many barriers over time. What is new however is the selection of particular materials that "suffer" from explosive spalling under certain conditions. One or more of the components identified will comprise a material that is subject to explosive spalling. For clarity, such material will be referred to herein as "spalling material".

The term "suffer" was selected because explosive spalling as a property or condition of materials is recognized as a highly undesirable condition. Materials engineers spend considerable effort trying to rid materials of this condition. Nevertheless, the inventors hereof have recognized that for specific purposes in which they are engaged, the selective use of materials suffering from this condition would be useful.

Figure 2:
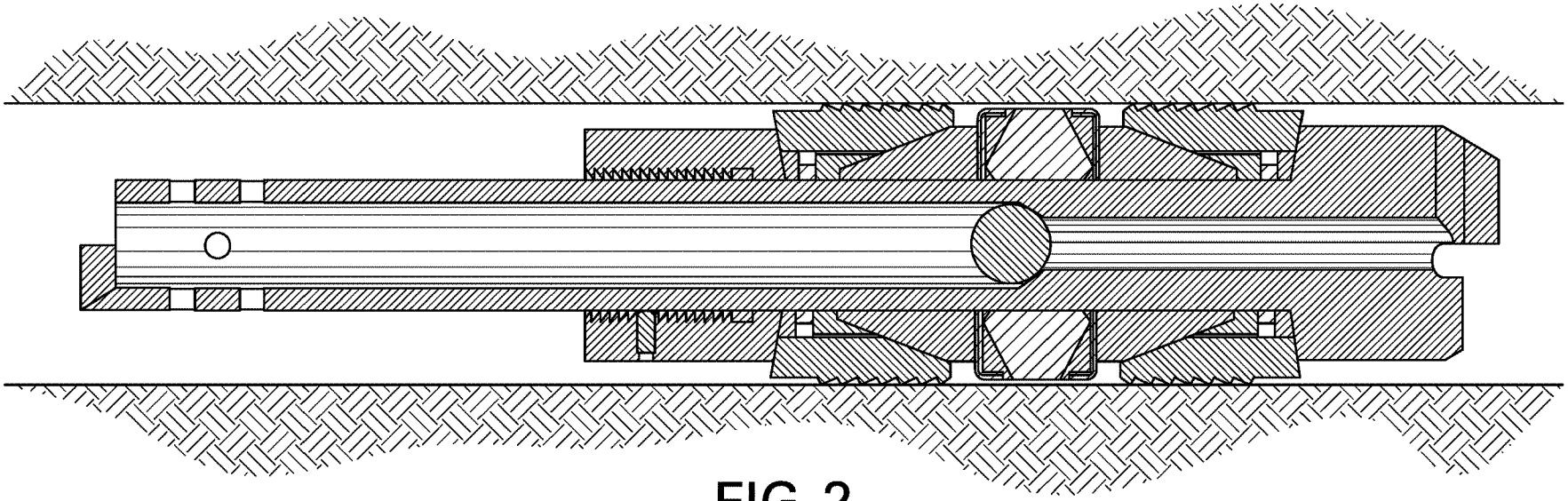
FIG. 2 illustrates the barrier of FIG. 1 in a set condition.
Figure 3:
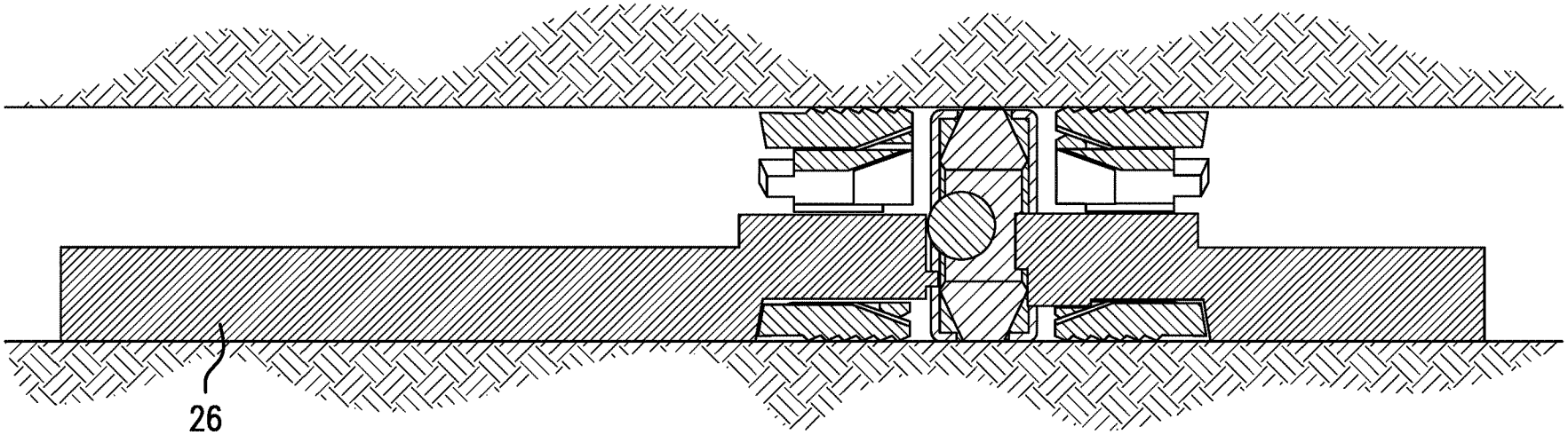
FIG. 3 illustrates the barrier of FIG. 1 after spalling of one or more components.

In an embodiment, the mandrel 12, pusher 14 and cones 16 and 18 are constructed of spalling material. Referring to FIGS. 2 and 3, one of ordinary skill in this art will recognize the barrier 10 set in FIG. 2 and will appreciate that FIG. 3 illustrates the condition of the components that comprised spalling material as rubble 26 after spalling occurs. The balance of the components in FIG. 3 are unsupported and may be circulated back out of the well, allowed to settle out of the way or be degraded if comprising degradable material such as InTallic™ corrodible metallic material or degradable polymeric material available from Baker Hughes, Houston Tex. Accordingly, using the iteration that is illustrated, the barrier 10 may be set in the well, a pressure (or force) operation may be executed against the barrier 10 and after the pressure (or force) operation the barrier 10 will self-destruct due to spalling of the components that comprise spalling material. It is to be understood that the illustrated embodiment where mandrel 12, pusher 14 and cones 16 and 18 are all spalling material is only an example. In other examples, only one component may comprise spalling material. Rather what is worthy of consideration is which components are selected for comprising spalling material. In iterations, making a structurally critical component comprise spalling material will have a greater effect on destabilization of the barrier 10 than if a noncritical structural component comprises spalling material. Having noted this, it will still be apparent to those of skill in the art that if any of the components that have anything to do with anchoring the barrier 10 in place are subject to spalling the ultimate intent of destabilizing the barrier 10 after use will be achieved. For example, if the slips 20 and 22 spall, the barrier would be destabilized even if the mandrel were not subject to spalling. It is also contemplated that all components could comprise spalling material.

It is contemplated that components that comprise spalling material may be all spalling material or only partly a spalling material. In either case, it is contemplated that the components may be created using casting processes, subtractive machining processes, additive manufacturing processes, or others. Casting is currently considered the most cost effective method.

Spalling of the components that comprise a spalling material will occur when the components are subject to a threshold temperature that will cause spalling of the material. In embodiments, the effective threshold temperature will be in a range of from 150 degrees Fahrenheit to 1100 degrees Fahrenheit for various materials. In other embodiments the range of threshold temperature would be 200 degrees Fahrenheit to 500 degrees Fahrenheit. It is to be understood that the threshold temperature desired may be adjusted by adjusting the chemistry of the spalling material. For example, one way of adjusting the chemistry of the spalling material would be to increase the percentage of free water therein. The threshold temperature for spalling of a material with more free water content may be lower than the threshold temperature for a material that requires water dissociation first simply because a lesser thermal load is required to vaporize water than to dissociate water and then vaporize that newly dissociated water. The water upon exposure to sufficient temperature input will vaporize, creating a significant amount of stress in the material, leading to its fracture. Another example does not add free water but due to other chemistry in the material, the exposure to sufficient thermal load will cause water to dissociate from other chemicals of the material thereby freeing the water otherwise bound in the material. Once the water is free the same vaporization reaction will occur. In addition, or as an alternative mechanism of action, the material itself will, of course, be subject to thermal stresses due to thermal gradient across the material. This is most profoundly effected by rapid changes in temperature. In an embodiment, the spalling material is susceptible to spalling where the heating rate of the material is 100 degrees Fahrenheit to 500 degrees Fahrenheit per minute or in another embodiment 5 degrees Fahrenheit to 100 degrees Fahrenheit per minute change in temperature such as an increase in temperature from a previous temperature to a temperature dictated by the intent of the operator. Such a rate in temperature rise will for selected spalling materials create significant thermal gradient strain in the material, leading to its spalling action. It will be appreciated that both of these mechanisms may also be employed together.

The threshold temperature may be effected by employing the ambient downhole temperature or adding temperature through various heating devices or chemical reactions. In embodiments, a temperature change may be introduced through a heating element run on wireline or by creating anexothermic chemical reaction through introduction of an appropriate chemical to react with chemicals in situ or through introduction of a number of chemicals sufficient to cause the exothermic reaction between themselves or by pumping a hot fluid.

Materials employed for the components that will spall as described above include Ultra High Performance Concrete materials, high strength concrete materials, reactive powder concrete materials, etc. used in structure construction such as buildings, bridges, garbage bins, park benches, statues, counter tops and flooring. One material subject to spalling is described hereinafter.

The material comprises a ductility modifying agent such as an ionomer; functionalized filler; a metallic fiber; a polymeric fiber; or a combination thereof. In addition to the ductility modifying agent, the cementing composition will also contain a cementitious material and an aggregate.

As used herein, ionomers are polymers that comprise ionic groups bonded to a neutral polymer backbone. The ionomers can be a homopolymer or a copolymer derived from two or more different monomers. Suitable ionic groups include a sulfonate group, a phosphonate group, a carboxylate group, a carboxyl group, a sulfonic acid group, or a phosphonic acid group. Combinations of the ionic groups can be used. The ionomers can have an ionic group content of about 0.5 mol % to about 20 mol % or about 3 mol % to about 10 mol % based on the total weight of the ionomers.

Ionomers can be prepared by introducing acid groups to a polymer backbone. If needed, the acid groups can be at least partially neutralized by a metal cation such as sodium, potassium, calcium, or zinc. In some embodiments, the groups introduced are already neutralized by a metal cation. The introduction of acid groups can be accomplished in at least two ways. In a first method, a neutral non-ionic monomer can be copolymerized with a monomer that is effective to provide pendant acid groups. Alternatively, acid groups can be added to a non-ionic polymer through post-reaction modifications.

Monomers that can provide acid groups include an acid anhydride based monomer, an ethylenically unsaturated sulfonic acid, an ethylenically unsaturated phosphoric acid, an ethylenically unsaturated carboxylic acid, a monoester of an ethylenically unsaturated dicarboxylic acid, or a combination comprising at least one of the foregoing. Specific examples of the monomers that can provide acid groups include maleic acid anhydride, vinyl sulfonic acid, vinyl phosphoric acid, acrylic acid, methacrylic acid, ethacrylic acid, itaconic acid, maleic acid, fumaric acid, methyl hydrogen maleate, methyl hydrogen fumarate, and ethyl hydrogen fumarate. The aid groups can be non-neutralized, partially, or completely neutralized with a metal ion such as sodium ions, potassium ions, zinc ions, magnesium ions, calcium ions, or aluminum ions. Ionomers can be derived from one or more monomers that can provide acid groups. Neutral non-ionic monomers can optionally be used together with acid group-containing monomers to make the ionomers. Neutral non-ionic monomers include olefins such as ethylene, propylene, butylene, butadiene, and styrene; vinyl acetate; and (meth) acrylates.

Ionic groups can also be grafted to a polymer backbone. For example, maleation is a type of grafting wherein maleic anhydride, acrylic acid derivatives or combinations thereof are grafted onto the backbone chain of a graftable polymer. In an embodiment, the graftable polymer is a polyolefin selected from polypropylene, polyethylene, or a combination thereof.

A large number of ionomers could be used in the cementing composition, including but are not limited to: carboxylated polyolefins, sulfonated fluorinated polyolefins, sulfonated ethylene-propylene-diene (EPDM), sulfonated polystyrene, phosphonated polyolefins, and the like. Exemplary carboxylated polyolefins include ethylene acrylic acid copolymer, an ethylene methacrylic acid copolymer, and an ethylene-acrylic acid-methacrylic acid ternary copolymer. Ethylene methacrylic acid copolymers (E/MAA) are commercially available as SURLYN from DuPont or LOTEK from ExxonMobil. Exemplary sulfonated fluorinated polyolefins include sulfonated tetrafluoroethylene based fluoropolymer-copolymer such as NAFION from DuPont (CAS Number 66796-30-3).

Figure 4:
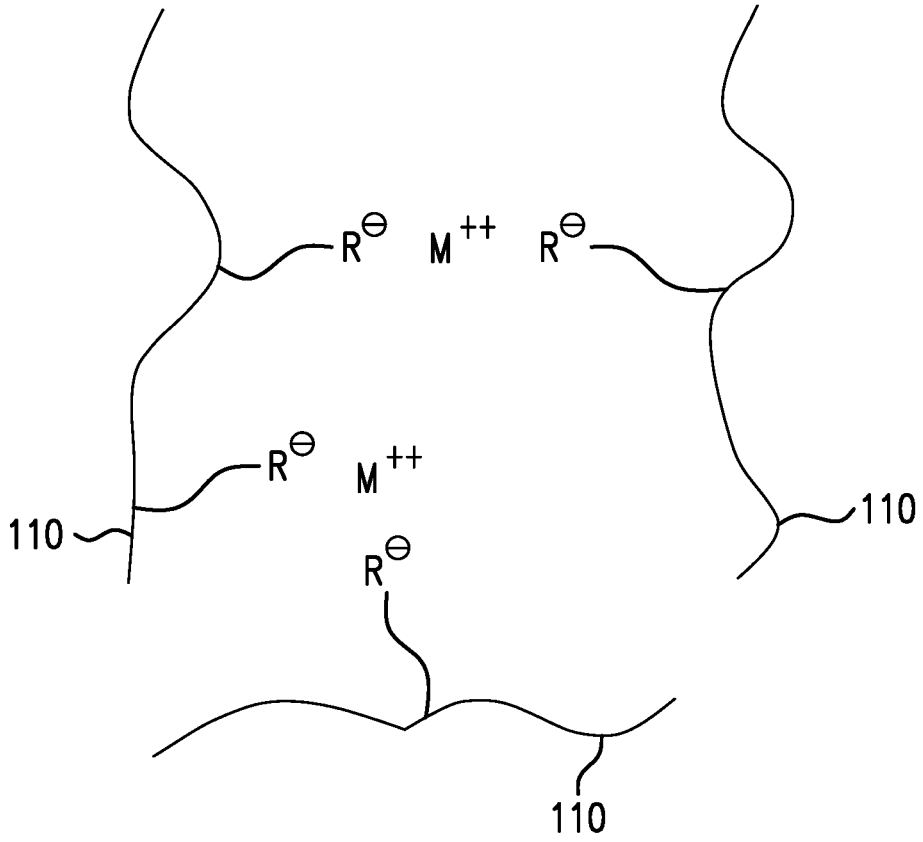
FIG. 4 illustrates the crosslinking between ionomers in a cementing composition according to an embodiment of the disclosure.

Without wishing to be bound by theory, it is believed that ionic groups can microphase separate from the non-polar part of polymer chain to form ionic clusters, which can act as physical crosslinks. In addition, ionic groups can also link to the metal cations in the cementitious material or hydrated cementitious material to produce chemical crosslinks. Exemplary metal cations include calcium ions, aluminum ions, zinc ions, magnesium ions, barium ions, or a combination comprising at least one of the foregoing. In the case of bivalent metal cations, a bridge-like crosslinks can be formed linking two ionomers together or linking an ionomer with other components in the component. FIG. 4 illustrates the crosslinking of two ionomers in the component. As shown in FIG. 4, polymer chains 110 can be crosslinked via the interaction between the ionic groups R on the ionomer and the metal cation present in the component. The incorporation of the polymer chains into a component thus can improve the ductility of the component.

Functionalized filler can also be used to improve the ductility and/or toughness of the components. Functionalized filler refers to a filler functionalized with one or more functional groups. Exemplary fillers include a carbon material, clays, silica, halloysites, polysilsequioxanes, boron nitride, alumina, zirconia, or titanium dioxide. A carbon material includes a fullerene, carbon nanotube, graphite, graphene, carbon fiber, carbon black, and nanodiamonds combinations of different filler materials can be used. The functionalized clay, functionalized halloysites, functionalized silicate, and functionalized silica can be functionalized nanoclay, functionalized nanohalloysites, functionalized nanosilicate, or functionalized nanosilica. In an exemplary embodiment, the functionalized filler includes functionalized carbon nanotubes. Carbon nanotubes are tubular fullerene structures having open or closed ends and which may be inorganic or made entirely or partially of carbon, and may include also components such as metals or metalloids. Nanotubes, including carbon nanotubes, may be single walled nanotubes (SWNTs) or multi-walled nanotubes (MWNTs).

Functional groups include a sulfonate group, a phosphonate group, a carboxylate group, a carboxyl group, a sulfonic acid group, or a phosphonic acid group, or a combination comprising at least one of the foregoing functional groups.

As used herein, "functionalized fillers" include both non-covalently functionalized fillers and covalently functionalized fillers. Non-covalent functionalization is based on van der Walls forces, hydrogen bonding, ionic interactions, dipole-dipole interactions, hydrophobic or π-π interactions. Covalent functionalization means that the functional groups are covalently bonded to the filler, either directly or via an organic moiety.

Any known methods to functionalize the fillers can be used. For example, surfactants, ionic liquids, or organometallic compounds having the functional groups comprising a sulfonate group, a phosphonate group, a carboxylate group, a carboxyl group, a sulfonic acid group, or a phosphonic acid group, or a combination comprising at least one of the foregoing can be used to non-covalently functionalize the fillers.

In an embodiment, boron nitride is non-covalently functionalized with an organometallic compound having a hydrophilic moiety and a functional group comprising a sulfonate group, a phosphonate group, a carboxylate group, a carboxyl group, a sulfonic acid group, or a phosphonic acid group, or a combination comprising at least one of the foregoing functional groups. Exemplary hydrophilic moieties include —$CH_2CH_2$—O—, —$CH_2$—CH(OH)—O—, and —OH.

The organometallic compound used to covalently functionalize boron nitride is a compound of the formulas (I), (II), (III), or (IV)

(formula I)

$$(RO)_xSiR'_y$$

(formula II)

$$(RO)_xTi(\overset{O}{\overset{\|}{C}}R')_{4-x}$$

-continued (Formula III)

$$(RO)_xZr(\overset{O}{\overset{\|}{C}}R')_{4-x} \quad \text{or}$$

(Formula IV)

$$(RO)_xAl(\overset{O}{\overset{\|}{C}}R')_{3-x},$$

In formulas (I)-(IV), R is a hydrophilic group such as a group containing an ether group, a hydroxyl group, or a combination comprising at least one of the foregoing. An exemplary R is —$CH_2$—$CH_2$—(—O—$CH_2$—$CH_2$—O)$_k$—OH, wherein k is zero to about 30. R' is a moiety containing a sulfonate group, a phosphonate group, a carboxylate group, a carboxyl group, a sulfonic acid group, or a phosphonic acid group, or a combination comprising at least one of the foregoing. R' has a structure of formula (V)-(X):

(Formula V)

$$-(CH_2-CH_2-O)_n-\overset{H_2}{C}-\overset{O}{\overset{\|}{C}}-OM$$

(Formula VI)

$$-(CH_2-CH_2-O)_n-\overset{H_2}{C}-\underset{\underset{O}{\|}}{\overset{O}{\overset{\|}{S}}}-OM$$

(Formula VII)

$$-(CH_2-CH_2-O)_n-\overset{H_2}{C}-\underset{\underset{OM}{|}}{\overset{OM}{\overset{|}{P}}}=O$$

(Formula VIII)

$$-(CH_2-\overset{OH}{\overset{|}{C}}H_2-O)_n-\overset{H_2}{C}-\overset{O}{\overset{\|}{C}}-OM$$

(Formula IX)

$$-(CH_2-\overset{OH}{\overset{|}{C}}H_2-O)_n-\overset{H_2}{C}-\underset{\underset{O}{\|}}{\overset{O}{\overset{\|}{S}}}-OM, \quad \text{or}$$

(Formula X)

$$-(CH_2-\overset{OH}{\overset{|}{C}}H_2-O)_n-\overset{H_2}{C}-\underset{\underset{OM}{|}}{\overset{OM}{\overset{|}{P}}}=O$$

wherein each n is independently 1 to 30, 1 to 20, or 1 to 10; and each M is independently H or a metal ion such as sodium ions, potassium ions, magnesium ions, barium ions, cesium ions, lithium ions, zinc ions, calcium ions, or aluminum ions.

Various chemical reactions can be used to covalently functionalize the fillers. Exemplary reactions include, but are not limited to, oxidization, reduction, amination, free radical additions, CH insertions, cycloadditions, polymerization via a carbon-carbon double bond, or a combination comprising at least one of the foregoing. In some embodiments, the fillers are covalently functionalized. Covalently functionalized carbon is specifically mentioned. As a specific example, the functionalized filler comprises carbon nanotubes functionalized with a sulfonate group, a carboxylic acid group, or a combination thereof.

In formula (I), x+y=4, x, y are greater than zero. In formulas (II) and (III), x is 1 to 3. In formula (IV), x is 1 or 2.

The filler can be in the particle form or fiber form. In an embodiment, the filler comprises nanoparticles. Nanoparticles are generally particles having an average particle size, in at least one dimension, of less than one micrometer. Particle size, including average, maximum, and minimum particle sizes, may be determined by an appropriate method of sizing particles such as, for example, static or dynamic light scattering (SLS or DLS) using a laser light source. Nanoparticles may include both particles having an average particle size of 250 nm or less, and particles having an average particle size of greater than 250 nm to less than 1 micrometer (sometimes referred in the art as "sub-micron sized" particles). In an embodiment, a nanoparticle may have an average particle size of about 1 to about 500 nanometers (nm), specifically 2 to 250 nm, more specifically about 5 to about 150 nm, more specifically about 10 to about 125 nm, and still more specifically about 15 to about 75 nm.

Figure 5:
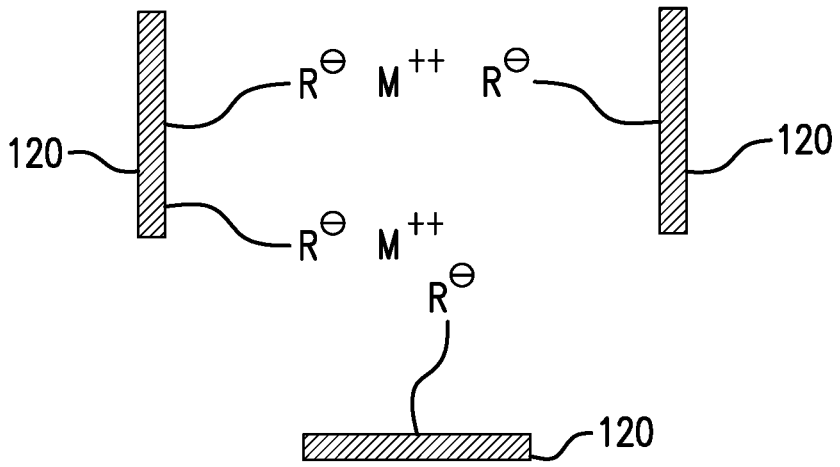
FIG. 5 illustrates the crosslinking between functionalized carbon in a cementing composition according to an embodiment of the disclosure.

In an embodiment, the functionalized carbon includes fluorinated, sulfonated, phosphonated, or carboxylated carbon nanotubes. These functionalized carbon nanotubes could covalently link to the metal cations of in the cementitious material or in the hydrated cementitious material in a similar way as ionomers do. Exemplary metal cations include calcium ions, aluminum ions, zinc ions, magnesium ions, barium ions, or a combination comprising at least one of the foregoing. FIG. 5 illustrates the crosslinking of two functionalized carbon nanotubes in the cementing composition. As shown in FIG. 5, carbon nanotubes 120 are crosslinked via the interaction between the ionic groups R on the carbon nanotubes and the metal cation present in the component.

In an embodiment, the ductility modifying agent comprises both the functionalized filler and the ionomer. In a specific embodiment, the ductility modifying agent comprises both the functionalized carbon nanotubes and ionomers. The component can comprise crosslinks between ionomers, crosslinks between functionalized fillers, crosslinks between ionomers and functionalized fillers, or a combination comprising at least one of the foregoing. In an embodiment, the ionomer, the functionalized filler, or both the ionomer and the functionalized filler are crosslinked with a metal ion in the component. Exemplary metal ions include the ions of magnesium, calcium, strontium, barium, radium, zinc, cadmium, aluminum, gallium, indium, thallium, titanium, zirconium, or a combination comprising at least one of the foregoing. Preferably the metal ions include the ions of one or more of the following metals: magnesium, calcium, barium, zinc, aluminum, titanium, or zirconium. The metal ions can be part of the cementitious material or the hydrated cementitious material or other components such as fly ash particles as well as by incorporation salts of cations capable of crosslinking ionomers with ionomers, crosslinking functionalized fillers with functionalized fillers, or crosslinking ionomers with functionalized fillers, or a combination thereof.

Figure 6:
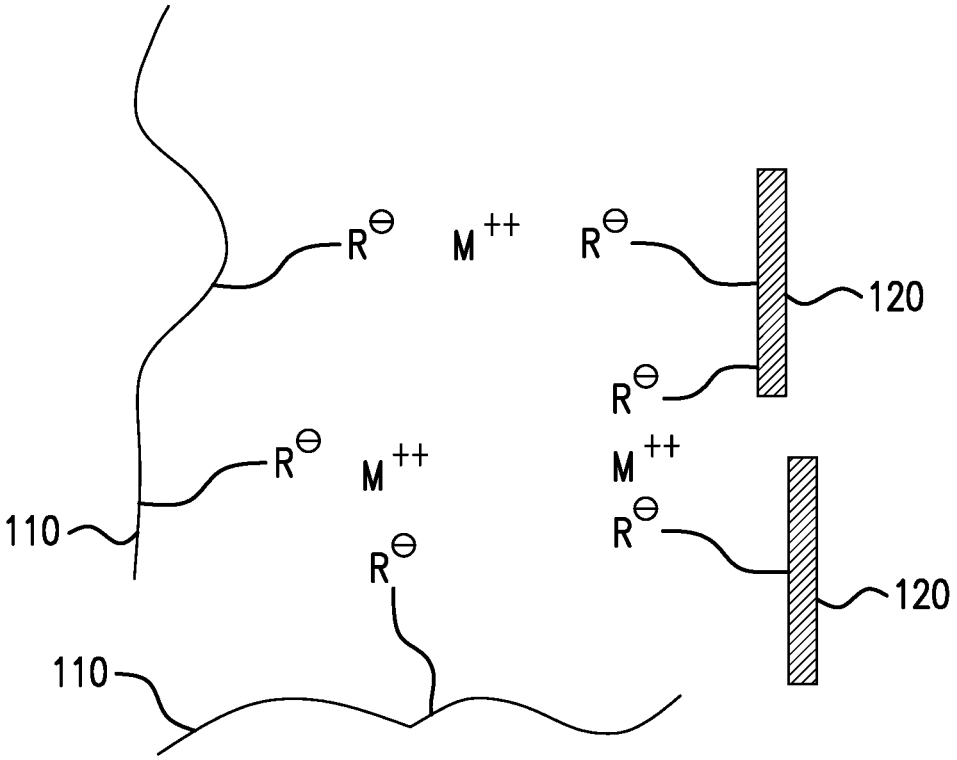
FIG. 6 illustrates the crosslinking between an ionomer and functionalized carbon in an exemplary cementing composition.

FIG. 6 illustrates the crosslinking of the ionomers and functionalized carbon in a component. As shown in FIG. 6, a polymer chain 110 can be crosslinked with another polymer chain 110 or crosslinked with a functionalized filler 120. Similarly, functionalized filler 120 can be crosslinked with another functionalized filler 120 or a polymer chain 110. Without wishing to be bound by theory, it is believed the cementing composition can have both improved ductility and improved strength when the composition contains both an ionomer and functionalized filler.

Functionalized filler, when present in the components, can be stabilized with a stabilizing agent comprising a surfactant, surface-active particles, or a combination comprising at least one of the foregoing. The stabilizing agent stabilizes the functionalized filler, in particular functionalized carbon in an aqueous carrier as a stabilized dispersion, which can be used to prepare the components. The stabilizing agent can be present in an amount of about 0.1 to 10 wt. % or 0.1 to 5 wt. % based on the weight of the components.

Exemplary surfactants include sodium dodecylbenzenesulfonate (SDBS); sodium dodecyl sulfate (SDS); poly (amidoamine) dendrimers (PAMAM dendrimers); polyvinylpyrrolidone (PVP), naphthalenesulfonic acid, polymer with formaldehyde, sodium salt, and cetyl (triethyl)ammonium bromide (CTAB).

Surface-active particles include Janus particles and non-Janus nanoparticles. The example of Janus particles that can be used to stabilize filler in an aqueous carrier is the Janus graphene oxide (GO) nanosheets with their single surface functionalized by alkylamine. The functionalization method is described in detail in Carbon, Volume 93, November 2015, Pages 473-483. Non-Janus nanoparticles that may stabilize filler in aqueous solution are hydrous zirconia nanoparticles. Without wishing to be bound by any theory, it is believed that highly charged zirconia nanoparticles segregate to regions near negligibly charged larger filler particles such as carbon particles because of their repulsive Coulombic interactions in solution and stabilize them in the aqueous dispersion.

The metallic fiber comprises steel fiber or iron fiber. The polymeric fiber comprises one or more of the following: polyvinyl alcohol fiber; polyethylene fiber; polypropylene fiber; polyethylene glycol fiber; or poly(ethylene glycol)-poly(ester-carbonate) fiber. Polyvinyl alcohol fibers are specifically mentioned. The fibers can have a length of about 0.5 mm to about 20 mm or about 0.5 mm to about 3 mm, and a diameter of about 20 microns to about 200 microns or about 30 microns to about 60 microns.

The ductility modifying agent can be present in the components in an amount of about 0.1 to about 20 wt. %, based on the total weight of the components, preferably about 1 to about 10 wt. %, based on the total weight of the components. In an embodiment, the components comprise about 0.1 to about 8 or about 0.5 to about 3 wt. % of a metal fiber, based on the total weight of the components. When the ductility modifying agent comprises the polymer fiber, the ductility modifying agent can be present in an amount of about 0.1 to about 10 wt. % or about 0.5 to about 5 wt. %, based on the total weight of the components. In an embodiment, the components comprise about 0.1 to about 10 wt. % or about 0.5 to about 5 wt. % of an ionomer, based on the total weight of the components. In an embodiment, the components comprise about 0.1 to about 10 wt. % or about 1 to about 5 wt. % of functionalized carbon, based on the total weight of the components. In yet another embodiment, the components comprise about 0.1 to about 10 wt. % or about 1 to about 5 wt. % of a functionalized carbon and about 0.1 to about 5 wt. % of the ionomer, each based on the total weight of the components.

The component further comprises a cementitious material. The cementitious material can be any material that sets and hardens by reaction with water. Suitable cementitious materials, including mortars and concretes, can be those typically employed in a wellbore environment, for example those comprising calcium, magnesium, barium, aluminum, silicon, oxygen, and/or sulfur. Such cementitious materials include, but are not limited to, Portland cements, pozzolan cements, gypsum cements, high alumina content cements, silica cements, and high alkalinity cements, or combinations of these. Portland cements are particularly useful. In some embodiments, the Portland cements that are suited for use are classified as Class A, B, C, G, and H cements according to American Petroleum Institute, API Specification for Materials and Testing for Well Cements, and ASTM Portland cements classified as Type I, II, III, IV, and V.

The cementitious material can be present in the components in an amount of about 5 wt. % to about 60 wt. % based on the total weight of the components, preferably about 15 to about 50 wt. % of the weight of the components, more preferably about 20 to about 50 wt. %, based on the total weight of the components.

The component can contain aggregate. The term "aggregate" is used broadly to refer to a number of different types of both coarse and fine particulate material, including, but are not limited to, sand, gravel, slag, recycled concrete, silica, glass spheres, limestone, feldspar, and crushed stone such as chert, quartzite, and granite. The fine aggregates are materials that almost entirely pass through a Number 4 sieve (ASTM C 125 and ASTM C 33). The coarse aggregate are materials that are predominantly retained on a Number 4 sieve (ASTM C 125 and ASTM C 33). In an embodiment, the aggregate comprises sand such as sand grains. The sand grains can have a size from about 1 μm to about 2000 μm, specifically about 10 μm to about 1000 μm, and more specifically about 10 μm to about 500 μm. As used herein, the size of a sand grain refers the largest dimension of the grain. Aggregate can be present in an amount of about 10% to about 95% by weight of the component, about 10% to about 85% by weight of the component, about 10% to about 70% by weight of the cementing composition, about 20% to about 80% by weight of the cementing composition, about 20% to about 70% by weight of the component, 20% to about 60% by weight of the component, about 20% to about 40% by weight of the component, 40% to about 90% by weight of the component, 50% to about 90% by weight of the component, 50% to about 80% by weight of the component, or 50% to about 70% by weight of the component.

The components further comprise an aqueous carrier fluid. The aqueous carrier fluid is present in the components in an amount of about 0.1% to about 30% by weight, specifically in an amount of about 0.5% to about 25% by weight, more specifically about 0.5 to about 20 wt. %, each based on the total weight of the components. The aqueous carrier fluid can be fresh water, brine (including seawater), an aqueous base, or a combination comprising at least one of the foregoing. It will be appreciated that other polar liquids such as alcohols and glycols, alone or together with water, can be used in the carrier fluid. In an embodiment, the components comprise water in an amount of about 0.1% to about 30% by weight, specifically in an amount of about 0.5% to about 25% by weight, more specifically about 0.5% to about 20% by weight, each based on the total weight of the components.

The components can further comprise various additives. Exemplary additives include a high range water reducer or a superplasticizer; a reinforcing agent, a self-healing additive, a fluid loss control agent, a weighting agent to increase density, an extender to lower density, a foaming agent to reduce density, a dispersant to reduce viscosity, a thixotropic agent, a bridging agent or lost circulation material, a clay stabilizer, or a combination comprising at least one of the foregoing. These additive components are selected to avoid imparting unfavorable characteristics to the components, and to avoid damaging the wellbore or subterranean formation. Each additive can be present in amounts known generally to those of skill in the art.

Weighting agents are high-specific gravity and finely divided solid materials used to increase density, for example silica flour, fly ash, calcium carbonate, barite, hematite, ilemite, siderite, wollastonite, hydroxyapatite, fluorapatite, chlorapatite and the like. In some embodiments, about 20 wt. % to about 50 wt. % of wollastonite is present in the components, based on the total weight of the components. Hollow nano- and microspheres of ceramic materials such as alumina, zirconia, titanium dioxide, boron nitride, and carbon nitride can also be used as density reducers.

High range water reducers or superplasticizers can be grouped under four major types, namely, sulfonated naphthalene formaldehyde condensed, sulfonated melamine formaldehyde condensed, modified lignosulfonates, and other types such as polyacrylates, polystyrene sulfonates.

Reinforcing agents include fibers such as metal fibers and carbon fibers, silica flour, and fumed silica. The reinforcing agents act to strengthen the set material formed from the cementing compositions.

Self-healing additives include swellable elastomers, encapsulated cement particles, and a combination comprising at least one of the foregoing. Self-healing additives are known and have been described, for example, in U.S. Pat. Nos. 7,036,586 and 8,592,353.

Exemplary components are provided. In an embodiment, the components comprise about 15 wt. % to about 50 wt. % of a cementitious material such as Portland cement, about 20 wt. % to about 60 wt. % of an aggregate such as sand; about 0.5 to about 12 wt. % of an ionomer, more specifically about 1 wt. % to about 5 wt. % of an ionomer, and about 0.5 wt. % to about 12 wt. % functionalized filler, more specifically about 2 wt. % to about 8 wt. % of functionalized filler such as functionalized carbon nanotubes, each based on the total weight of the components. The components can also contain about 0.5 wt. % to about 25 wt. % or about 0.5 wt. % to about 20 wt. % of water, based on the total weight of the components. Additional additives as disclosed herein can also be included in the components.

In another embodiment, the components comprise about 15 wt. % to about 50 wt. % of a cementitious material such as Portland cement, about 20 wt. % to about 60 wt. % of an aggregate such as sand; and about 0.1 to about 8 wt. % or about 0.5 wt. % to about 3 wt. % of metallic fibers such as steel fibers, each based on the total weight of the components. The components can also contain about 0.5 wt. % to about 25 wt. % or about 0.5 wt. % to about 20 wt. % of water, based on the total weight of the components. Additional additives as disclosed herein can also be included in the components.

In still another embodiment, the components comprise about 15 wt. % to about 50 wt. % of a cementitious material such as Portland cement, about 20 wt. % to about 60 wt. % of an aggregate such as sand; and about 1 wt. % to about 10 wt. % or about 1 wt. % to about 5 wt. % of polymeric fibers, each based on the total weight of the components. The components can also contain about 0.5 wt. % to about 25 wt. % or about 0.5 wt. % to about 20 wt. % of water, based on the total weight of the components. Additional additives as disclosed herein can also be included in the components.

As a specific example, the components comprise about 25 wt. % to about 30 wt. % of a cementitious material such as Portland cement, about 35 wt. % to about 45 wt. % of aggregate such as sand; about 5 wt. % to about 15 wt. % of silica fume; about 5 wt. % to about 10 wt. % of ground quartz, about 0.5 wt. % to about 3 wt. % of a high range water reducer; about 0.5 wt. % to about 3 wt. % of an accelerator; and about 2 wt. % to about 10 wt. % of metal fibers such as steel fibers, each based on the total weight of the components.

As another specific example, the components comprise about 25 to about 40 wt. % of a cementitious material such as Portland cement, about 5 wt. % to about 12 wt. % of silica fume, about 5 wt. % to about 15 wt. % of quartz powder, about 30 wt. % to about 45 wt. % of sand, 0.5 wt. % to about 7 wt. % of metal fibers, and about 0.1 wt. % to about 5 wt. % of a superplasticizer, each based on the total weight of the components.

By decreasing the size of the cement components, such as sand, cement, and filler particles size, and fiber diameters, greater synergy of properties can be achieved due to increased interfacial area between components, leading to improved ductility and higher strength. In some embodiments, all the solid particles in the components have a particle size of less than about 100 microns or less than about 20 microns. The diameters of the fibers are less than about 100 microns or less than about 20 microns.

The ingredients of the components can be mixed together in the presence of a carrier and then molded or casted forming the component. The carrier can be an aqueous carrier fluid and is used in an amount of about 1% to about 60% by weight, more specifically in an amount of about 1% to about 40% by weight, based on the total weight of the compositions to form the components.

If necessary, the molded or casted component can be further heat treated at a temperature of 150° F. to about 1,000° F. and a pressure of about 100 psi to about 10,000 psi for about 30 minutes to about one week. Without wishing to be bound by theory, it is believed that the heat treatment can strength the components at a microscopic level.

The components have a compressive strength of about 5 ksi to about 150 ksi, specifically about 20 ksi to about 60 ksi. The components can be a frustoconical member or a bottom sub for a downhole tool. In another embodiment, combinations of the components are used together for the downhole tool to control fluid flow.

Figure 7:
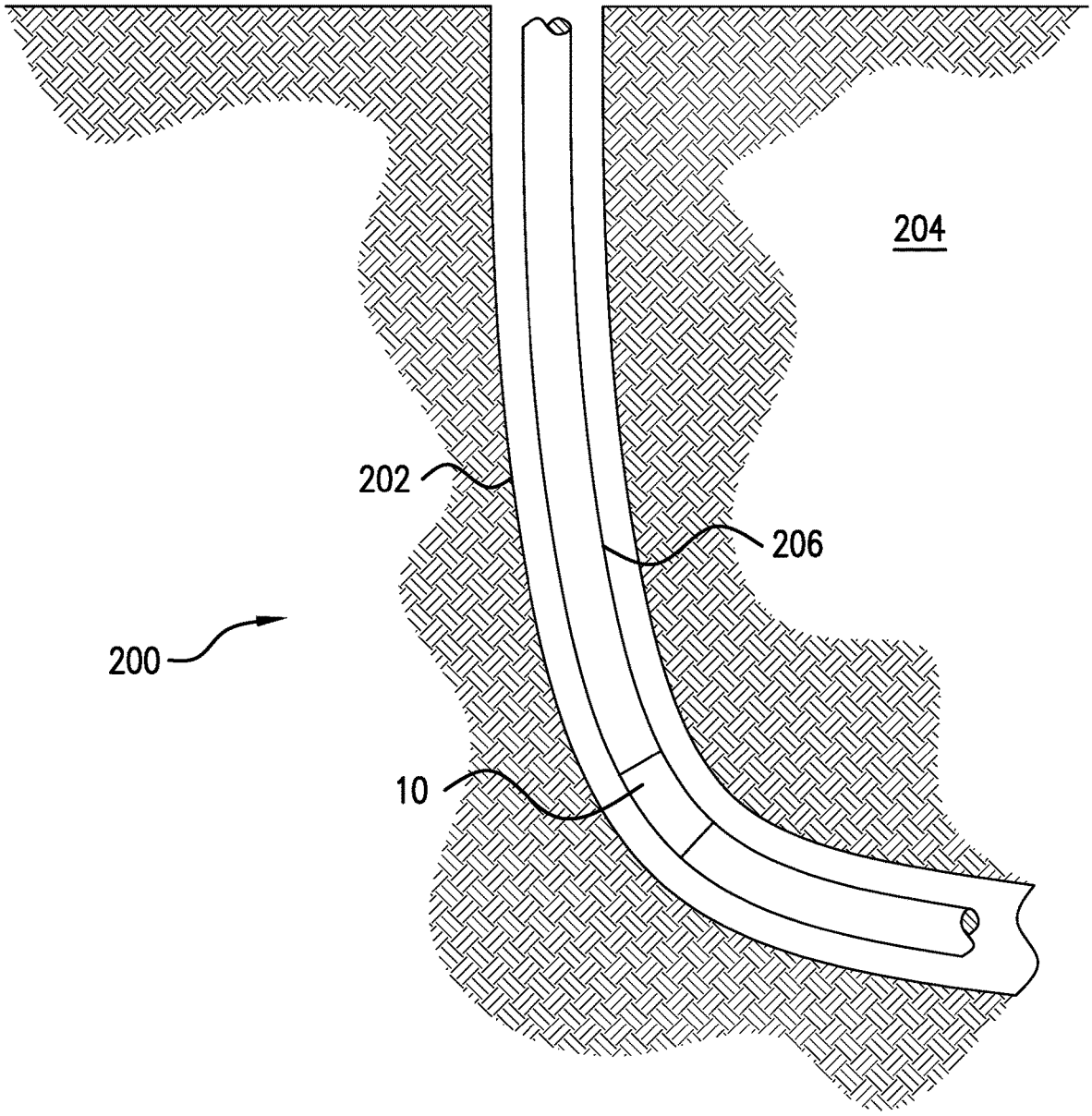
FIG. 7 illustrates a borehole system.

Referring to FIG. 7, a borehole system 200 is illustrated comprising a borehole 202 disposed in a subsurface formation 204. A barrier 10 as described above is disposed in the borehole either in open hole or within a string 206 as shown.

Set forth below are various embodiments of the disclosure.

Embodiment 1: A downhole barrier having a component thereof comprising a spalling material.

Embodiment 2: A downhole barrier as in any prior embodiment, wherein both a mandrel; and a cone, comprise the spalling material.

Embodiment 3: The downhole barrier as in any prior embodiment, further including a slip, and an element.

Embodiment 4: The downhole barrier as in any prior embodiment, wherein the slip comprises a spalling material.

Embodiment 5: The downhole barrier as in any prior embodiment further including a pusher.

Embodiment 6: The downhole barrier as in any prior embodiment, wherein the pusher comprises a spalling material.

Embodiment 7: A method for destabilizing a barrier in a borehole including initiating a threshold temperature of a barrier as in any prior embodiment, whereat the barrier spalls.

Embodiment 8: The method as in any prior embodiment, wherein the initiating includes phase transitioning free water in the spalling material.

Embodiment 9: The method as in any prior embodiment, wherein the initiating includes unbinding water in the material.

Embodiment 10: The method as in any prior embodiment, wherein the initiating includes creating a thermal gradient in the spalling material.

Embodiment 11: The method as in any prior embodiment, wherein the initiating is allowing ambient downhole temperature to raise the barrier to the threshold temperature.

Embodiment 12: The method as in any prior embodiment, wherein the initiating is by pumping a fluid having a different temperature to the barrier.

Embodiment 13: The method as in any prior embodiment, wherein the initiating is by applying a selected temperature to the barrier using a device capable of generating a temperature change therein.

Embodiment 14: The method as in any prior embodiment, wherein the device is electrically activated.

Embodiment 15: The method as in any prior embodiment, wherein the device is a heater.

Embodiment 16: The method as in any prior embodiment, wherein the initiating is by causing an exothermic chemical reaction at the barrier.

Embodiment 17: A borehole system including a borehole in a subsurface formation, a barrier as in any prior embodiment disposed in the borehole.

Embodiment 18: The borehole system as in any prior embodiment, further including a string in the borehole, the barrier being disposed in the string.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A downhole barrier having a component thereof comprising a spalling material, wherein the spalling material comprises a cementitious material, an aggregate, and a ductility modifying agent; and the downhole barrier spalls upon phase transitioning free water in the spalling material or upon unbinding water in the spalling material, wherein downhole barrier further comprises a device capable of generating a temperature change therein or a material capable of undergoing an exothermic reaction, to initiate phase transitioning free water in the spalling material.

2. A downhole barrier as claimed in claim 1 wherein both a mandrel; and a cone, comprise the spalling material.

3. The downhole barrier as claimed in claim 2 further including a slip, and an element.

4. The downhole barrier as claimed in claim 3 wherein the slip comprises a spalling material.

5. The downhole barrier as claimed in claim 3 further including a pusher.

6. The downhole barrier as claimed in claim 3 wherein the pusher comprises a spalling material.

7. A method for destabilizing a barrier in a borehole comprising;

initiating a threshold temperature of a barrier as claimed in claim 1 whereat the barrier spalls.

8. The method as claimed in claim 7 wherein the initiating includes phase transitioning free water in the spalling material.

9. The method as claimed in claim 7 wherein the initiating includes unbinding water in the material.

10. The method as claimed in claim 7 wherein the initiating includes creating a thermal gradient in the spalling material.

11. The method as claimed in claim 7 wherein the initiating is allowing ambient downhole temperature to raise the barrier to the threshold temperature.

12. The method as claimed in claim 7 wherein the initiating is by pumping a fluid having a different temperature to the barrier.

13. The method as claimed in claim 7 wherein the initiating is by applying a selected temperature to the barrier using a device capable of generating a temperature change therein.

14. The method as claimed in claim 13 wherein the device is electrically activated.

15. The method as claimed in claim 13 wherein the device is a heater.

16. The method as claimed in claim 7 wherein the initiating is by causing an exothermic chemical reaction at the barrier.

17. A borehole system comprising:

a borehole in a subsurface formation;

a barrier as claimed in claim 1 disposed in the borehole.

18. The borehole system as claimed in claim 17 further including a string in the borehole, the barrier being disposed in the string.

19. The downhole barrier as claimed in claim 1, wherein the downhole barrier undergoes explosive spalling upon phase transitioning free water in the spalling material or upon unbinding water in the spalling material.

* * * * *